United States Patent [19]

Hansen et al.

[11] Patent Number: 5,017,098

[45] Date of Patent: May 21, 1991

[54] POWER TRANSMISSION

[75] Inventors: Lowell D. Hansen, Jackson, Miss.; J. Richard Hurley, Clayton, Ind.; Jean J. Schweitzer, Brandon, Miss.; Walter J. Zoya, Scottsdale, Ariz.

[73] Assignee: Vickers, Incorporated, Troy, Mich.

[21] Appl. No.: 318,553

[22] Filed: Mar. 3, 1989

[51] Int. Cl.[5] ..... F04B 49/00

[52] U.S. Cl. ..... 417/302; 417/504; 418/15; 418/268

[58] Field of Search ..... 417/302, 304, 504, , 417/442, 303, 308; 418/15, 268, 266, 267, 133

[56] References Cited

U.S. PATENT DOCUMENTS

| | | | |
|---|---|---|---|
| 2,445,573 | 7/1948 | Godbe, Jr. | 418/15 |
| 2,832,199 | 4/1958 | Adams et al. | 418/15 |
| 2,853,023 | 9/1958 | English | 418/267 |
| 2,924,182 | 2/1960 | Blasutta et al. | 418/133 |
| 3,204,565 | 9/1965 | Kirkpatrick | 418/133 |
| 3,645,654 | 2/1972 | Niemiec et al. | 418/133 |
| 4,183,723 | 1/1980 | Hansen et al. | 418/15 |
| 4,286,933 | 9/1981 | Sakamaki et al. | 418/15 |
| 4,480,654 | 11/1984 | Firey | 417/442 |

FOREIGN PATENT DOCUMENTS

| | | | |
|---|---|---|---|
| 515809 | 8/1955 | Canada | 418/133 |

*Primary Examiner*—Leonard E. Smith

*Attorney, Agent, or Firm*—Barnes,Kisselle,Raisch,Choate,Whittemore & Hulbert

[57] ABSTRACT

A split-discharge balanced dual-lobe vane-type rotary hydraulic machine that comprises a housing, a rotor mounted within the housing and having a plurality of radially extending peripheral slots, and a plurality of vanes individually slidably mounted in the rotor slots. A cam ring within the housing surrounds the rotor and has a radially inwardly directed surface forming a track for sliding engagement with the vane. Opposed symmetrical pressure cavities are formed between the cam ring surface and the rotor, and fluid inlet and outlet passages in the housing are coupled to the fluid pressure cavities. The fluid inlet and outlet passages include a fluid inlet port opening into each cavity adjacent to one circumferential edge thereof, a first fluid outlet port opening into each cavity adjacent to the opposing circumferential edge thereof, and a second fluid outlet port opening into each cavity at a position circumferentially between the inlet and first outlet ports.

4 Claims, 4 Drawing Sheets

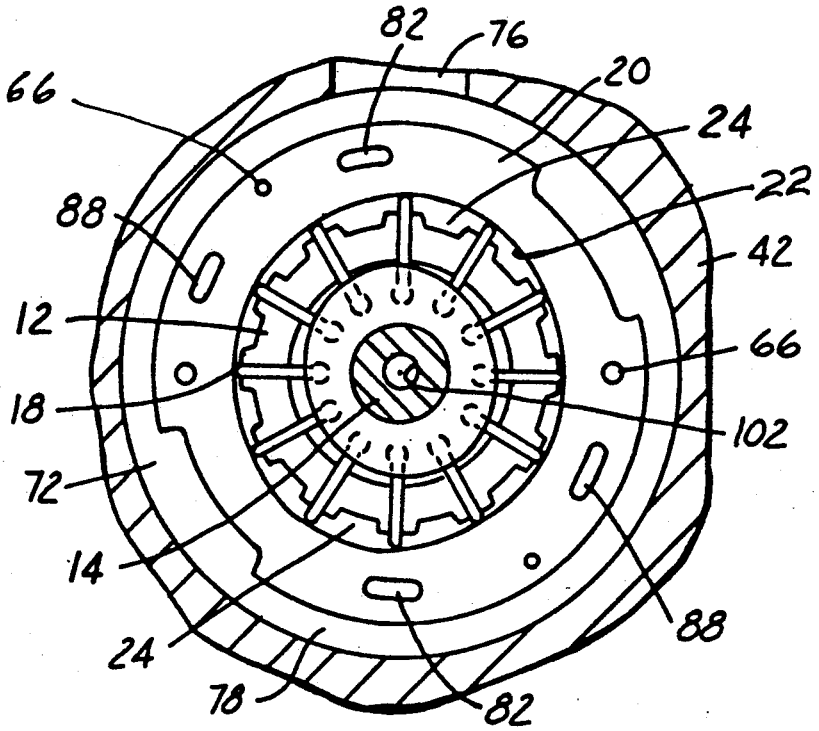
FIG. 5
FIG. 8
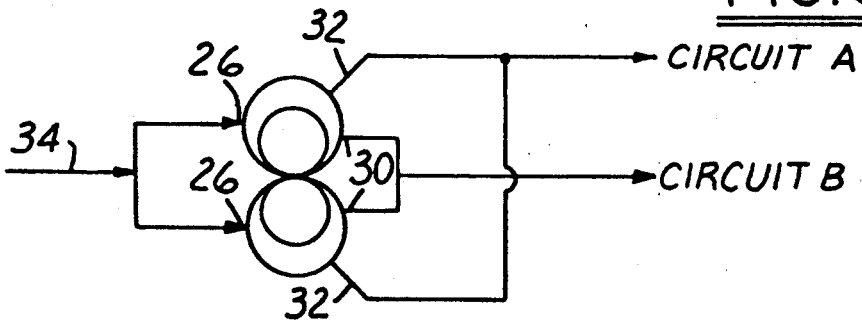
FIG. 9
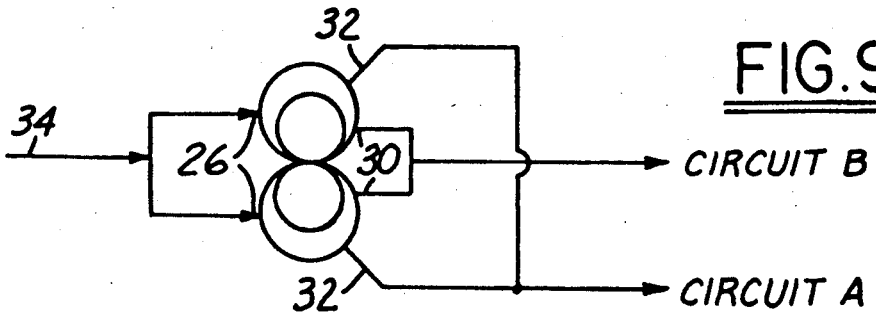

POWER TRANSMISSION

The present invention is directed to rotary hydraulic machines, and particularly to sliding-vane machines capable of functioning as hydraulic pumps, motors, flow dividers, pressure intensifiers and the like.

BACKGROUND AND OBJECTS OF THE INVENTION

Rotary hydraulic machines of the subject type generally include a housing, a rotor mounted for rotation within the housing, and a plurality of vanes individually slidably disposed in corresponding radially extending peripheral slots in the rotor. A cam ring radially surrounds the rotor, and has an inwardly directed surface forming a vane track and one or more fluid pressure cavities between the cam surface and the rotor. Inlet and outlet passages feed hydraulic fluid to and from the cavities. Fluid inlet and outlet ports are positioned at circumferentially spaced edges of the fluid cavities.

It is desirable to match fluid displacement in machines of the subject type to operating characteristics of the system with which the machine is to be associated. For example, maximum displacement of a vane-type fuel pump is coordinated with maximum fuel requirements of the associated engine application. However, system requirements typically vary with operating conditions, so that a fixed displacement machine designed as a function of the most demanding operating conditions may function with less than desired efficiency under other operating conditions. In the exemplary case of a fuel pump, fuel flow requirements under engine starting conditions greatly exceed requirements during normal operation. It has heretofore been proposed to provided relatively complex and expensive valving arrangements (flow or fuel controls) at the pump outlet to meter a portion of the pump output to the engine as a function of engine demand, while returning the remainder to the pump inlet causing fuel heating from the throttling effects.

A general object of the present invention, therefore, is to provide a rotary hydraulic machine of the subject type in which effective machine displacement can be controlled as a function of demand, and yet is inexpensive to manufacture and assemble as compared with variable-displacement rotary hydraulic machines of the prior art. Another object of the present invention is to provide a machine of the described character that is compact in assembly. A further and more specific object of the invention is to provide a split-discharge balanced duallobe vane-type machine design that may be employed as a pump, motor, flow divider, pressure intensifier or the like with minimum modification to overall design principles and components.

SUMMARY OF THE INVENTION

The present invention contemplates a vane-type rotary hydraulic machine that comprises a housing, a rotor mounted within the housing and having a plurality of radially extending peripheral slots, and a plurality of vanes individually slidably mounted in the rotor slots. A cam ring within the housing surrounds the rotor and has a radially inwardly directed surface forming a track for sliding engagement with the vane. At least one fluid pressure cavity is formed between the cam ring surface and the rotor, and fluid inlet and outlet passages in the housing are coupled to the fluid pressure cavity. In accordance with a distinguishing feature of the present invention, the fluid inlet and outlet passages include a fluid inlet port opening into the cavity adjacent to one circumferential edge thereof, a first fluid outlet port opening into the cavity adjacent to the opposing circumferential edge thereof, and a second fluid outlet port opening into the cavity at a position circumferentially between the inlet and first outlet ports. The first and second outlet ports thus cooperate with the inlet port and the fluid pressure cavity effectively to form a dual displacement machine in which each displacement may be coordinated with operating system characteristics at one nominal design operating condition, thereby forming a machine that not only matches the operating system at two specific system conditions, but also more closely matches system requirements over the entire range of system conditions.

In accordance with presently preferred embodiments of the invention, the rotary hydraulic machine comprises a split-discharge balanced dual-lobe machine in which the cam ring and rotor cooperate to form diametrically opposed symmetrically positioned fluid pressure cavities. A fluid inlet port opens into each cavity at the leading edge thereof with respect to the direction of rotor rotation, a first fluid outlet port opens into each cavity adjacent to the trailing edge thereof, and a second fluid outlet port opens into each cavity circumferentially between the associated inlet and first outlet ports. The ports are symmetrically diametrically positioned with respect to the rotor for enhanced balance. The housing in the preferred embodiments of the invention comprises a cupshaped enclosure or shell, and first and second backup plates telescopically received within the cup-shaped enclosure and having the rotor sandwiched therebetween. The fluid inlet includes a radially orientated inlet opening aligned with the rotor. The first and second fluid outlets include a pair of annular channels on a radially facing surface of one of the backup plates, a first passage in the backup plate coupling a first of the channels to both of the first cavity outlet ports, a second passage in the backup plate coupling the other of the channels to both of the second cavity outlet ports, and a pair of radially orientated outlet openings in the enclosure in respective radial alignment with the channels. Most preferably, the machine of the present invention further includes one or more control valves for selectively directing fluid from one of the cavity outlet ports to inlet port or to a secondary flow circuit.

The invention finds particular advantage in aircraft fuel systems by permitting the displacement of the pump to be split or selected to match engine fuel system needs more closely. When pump outlets are combined, the total displacement of the pump is available for engine needs at the maximum flow capability of the combined displacements, particularly at engine lightoff conditions or at maximum engine fuel flow demands such as take-off. When the flows are split, the engine system now has two separate and distinct flow circuits to use for engine needs. One may be used for running the engine and the second for airframe motive flow, secondary engine fuel system, or returned to the aircraft tank or to the pump inlet. The invention enables a reduction in the heat rise in the fuel system by using a pump more ideally sized for the engine needs, and by reducing the amount of fuel bypassed in typical engine fuel controls.

BRIEF DESCRIPTION OF THE DRAWINGS

The invention, together with additional objects, features and advantages thereof, will be best understood from the following description, the appended claims and the accompanying drawings in which:

FIGS. 4 and 5 are fragmentary sectional views taken substantially along the respective lines 4—4 and 5—5 in FIG. 3;

FIG. 8 is a schematic diagram of a vane-type rotary hydraulic machine in accordance with the invention in a flow divider circuit, and FIG. 9 is a schematic diagram of a vane-type rotary hydraulic machine in accordance with the invention in a pressure intensifier circuit.

DETAILED DESCRIPTION OF PREFERRED EMBODIMENTS

Figure 1:
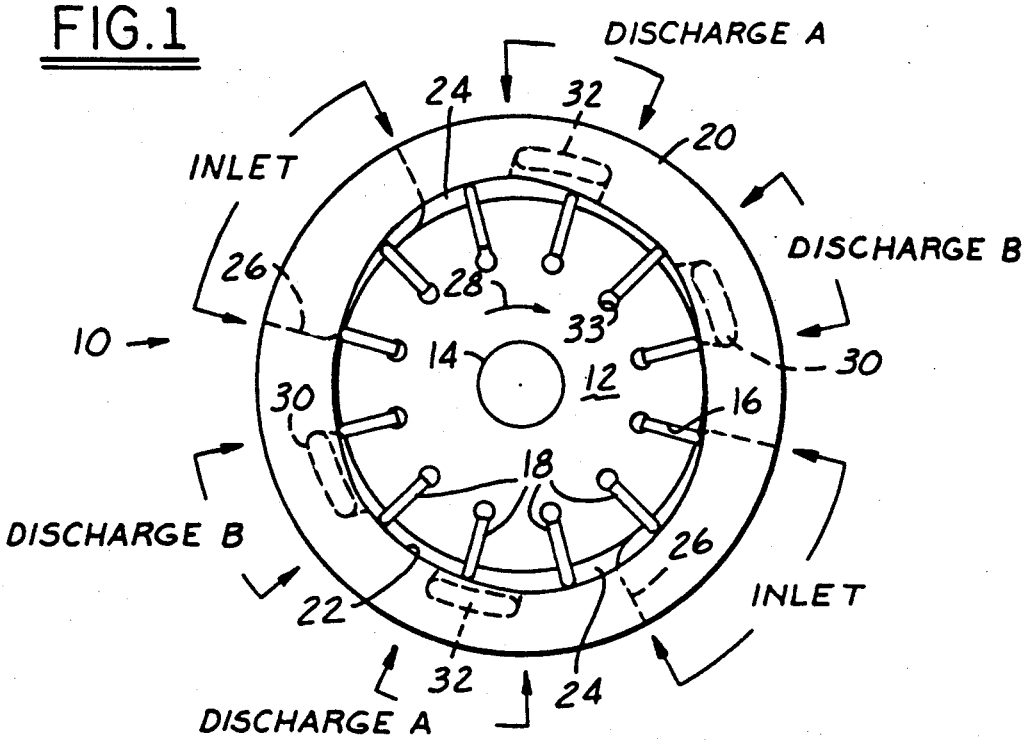
FIG. 1 is a typical cross-sectional diagram of a vane-type rotary hydraulic machine in accordance with the present invention.

FIG. 1 schematically illustrates a split-discharge dual-displacement balanced dual-lobe rotary hydraulic machine 10 in accordance with a presently preferred embodiment of the invention as comprising a rotor 12 having a circular periphery and mounted for free rotation about a shaft 14. Rotor 12 has a circumferential array of radially directed slots 16 in which a corresponding plurality of vanes 18 are radially slidably disposed. A cam ring 20 radially surrounds rotor 12 and has an inwardly directed cam ring surface 22 that cooperates with rotor 12 and vanes 18 to form a pair of diametrically opposed symmetrical fluid pressure cavities 24. Hydraulic fluid is fed through inlet passages to a pair of radially opposed inlet ports 26, each opening into an associated cavity 24 at the leading edge thereof with respect to the direction 28 of rotation of rotor 12. Likewise, fluid outlet passages receive fluid from a pair of diametrically opposed first outlet ports 30 that open into respective cavities 24 adjacent to the trailing circumferential edges thereof with respect to direction 28 of rotation. Fluid under pressure is also fed by appropriate passages to a chamber 33 positioned beneath each vane 18 for urging the vanes radially outwardly against cam ring surface 22. To the extent thus far described, machine 10 is of generally conventional construction.

In accordance with the present invention, a second pair of diametrically opposed outlet ports 32 open into respective cavities 24 at positions circumferentially between the associated inlet port 26 and first outlet port 30. Thus, fluid received at each inlet port 26 is discharged first at an adjacent outlet port 32 and then at a outlet port 30, with fluid discharge pressure at each outlet port being a function of contour of cam ring surface 22. There is, of course, a circumferential dwell region between each successive pair of ports, coordinated with circumferential spacing between vanes 18, so that the ports are isolated from each other in operation.

FIG. 8 is a schematic diagram of machine 10 connected as a flow divider for the dividing of the incoming fluid flow into two circuits having the total equivalent flow of the incoming fluid divided into two circuits at a pre-determined ratio. Inlet ports 26 receive fuel under pressure from a source 34. Ports 32 are connected together to form a first discharge A for a portion of the incoming flow 34. Ports 30 are connected together to form a second discharge B accepting the balance of the incoming flow 34. The flow division between ports 32 and 30 may be of any given amount so long as the total is the same as the inlet flow from source 34.

FIG. 9 is a schematic diagram of machine 10 connected as a pressure intensifier for increasing the pressure level of a portion of the fluid flow to a higher pressure level (pumping function) while returning the remaining portion to a lower pressure (motor function). Inlet ports 26 receive fuel under pressure from a source 34. Ports 32 are connected together to form a first discharge A at a higher pressure (pumping function) to provide a fluid flow source at a higher pressure than normally feed from pressure source 34. Ports 30 are connected together to form a second discharge B returning the fluid to the tank or to the inlet for fluid source 34. The function of ports 32 and 30 may be reversed depending on the particular fluid circuit needs.

Figure 3:
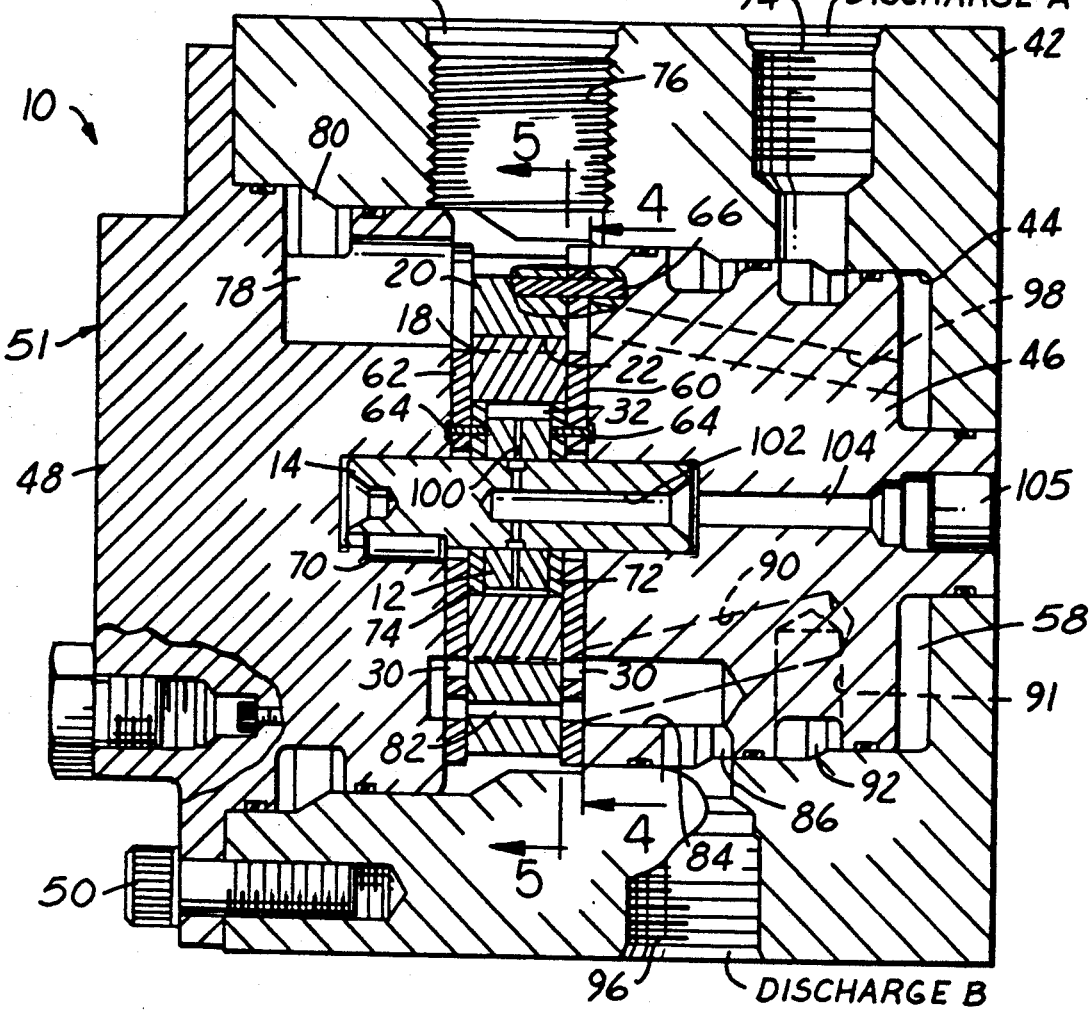
FIG. 3 is a sectional view of a fluid flow divider embodying the principles of the present invention in accordance with one presently preferred embodiment thereof.
Figure 4:
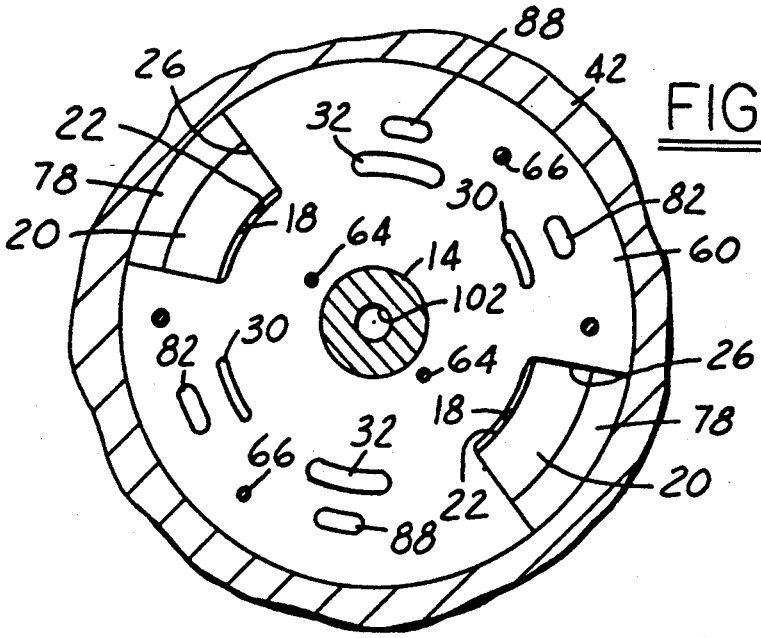

FIGS. 3-5 illustrate a working embodiment of pressure intensifier 10 as comprising a cup-shaped enclosure or shell 42 having a stepped radially inwardly directed wall 44. A pair of backup plates 46, 48 are telescopically received within enclosure 42, backup plate 48 being fastened by screws 50 to the open axial edge of enclosure 42 to form the complete housing 51, and backup plate 46 being spaced by a fluid cavity 58 from the enclosure base. A pair of opposed pressure or port plates 60, 62 are fastened by pins 64 to the axially opposed surfaces of backup plates 46, 48. Cam ring 20 is mounted by pins 66 to backup plate 46 between plate 46 and plate 48. Rotor 12 is mounted for free rotation on a stub shaft 14 that is captured between backup plates 46, 48 and held by a pin 70 against rotation with respect thereto. A pair of cam plates 72, 74 are mounted by pins 64 within opposing pockets of rotor 12, and have peripheries that engage the inner edges of vanes 18 and thereby positioned the vanes in radial proximity to the opposing surface 22 of cam ring 20. (Cam plates 72, 74 are the subject of co-pending application Ser. No. 07/314,884 filed Feb. 24, 1989 and assigned to the assignee hereof.)

An internally threaded inlet opening 76 extends radially through the peripheral wall of enclosure 42 in radial alignment with rotor 12. A passage 78 in backup plate 48 connects inlet 76 with a channel 80 that extends circumferentially around the radially-facing wall of backup plate 48. Channel 80 is connected by another passage 78 to the other inlet port 26. Ports 26 are formed as radially tapering slots in pressure plates 60, 62 (FIGS. 3 and 4). Each first outlet port 30 is formed as axially aligned apertures in both pressure plates 60, 62, the apertures being interconnected by a passage 82 (FIGS. 3 and 4) that extends through cam ring 20, and by a passage 84 (FIG. 3) that extends axially into backup plate 46 to open into a radially outwardly directing annular channel 86 in the side surface thereof. Likewise, each second outlet port 32 is formed as axially aligned apertures in backup plates 60, 62 that are interconnected by passages 88 extending through the pressure plates and the cam ring, and by passages 90, 91 (FIG. 3) to a radially outwardly facing annular channel 92 in the sidewall of backup plate 46. A pair of radially orientated internally threaded outlet openings 94, 96 extend through the sidewall of enclosure 12 in radial alignment with channels 92, 86 respectively to form discharge A and B discharge as previously described. Inlet 76 is also connected by a passage 98 (FIG. 3) in backup plate 46 to cavity 58 for urging backup plate 46 toward rotor 12 and backup plate 48. Likewise, undervane chambers 32 receive fluid under pressure by passages (not shown) in the backup plates and pressure plates. Fluid at undervane pressure is available for reference through passages 100 in rotor 12, 102 in shaft 14 and 104 in backup plate 46. Passage 104 is normally blocked by a plug 105.

Figure 6:
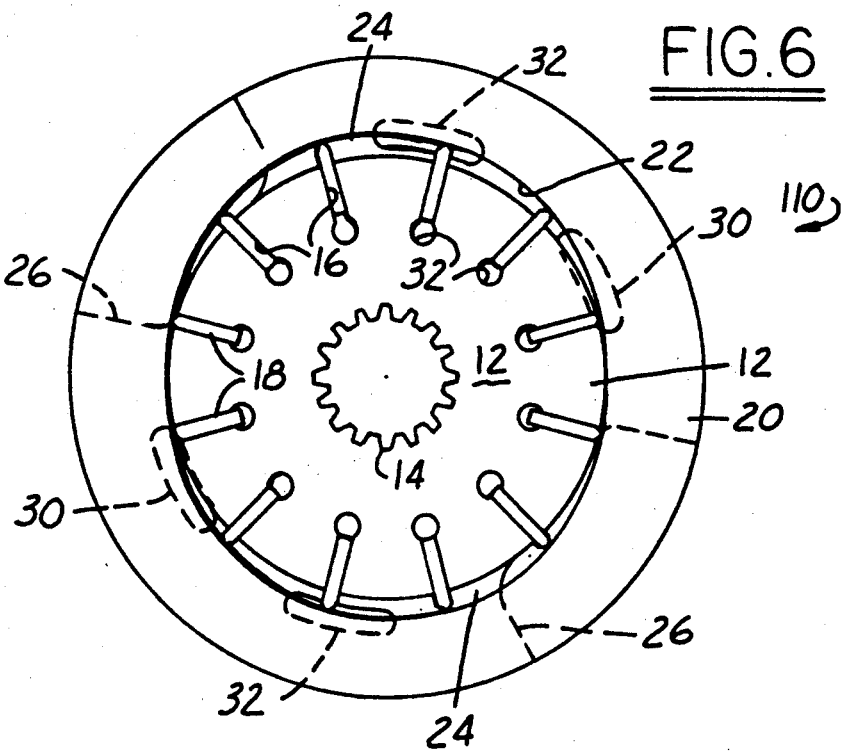
FIG. 6. is a typical cross-sectional diagram similar to that of FIG. 1 showing a rotary hydraulic vane-type pumps in accordance with another embodiment of the invention.
Figure 7:
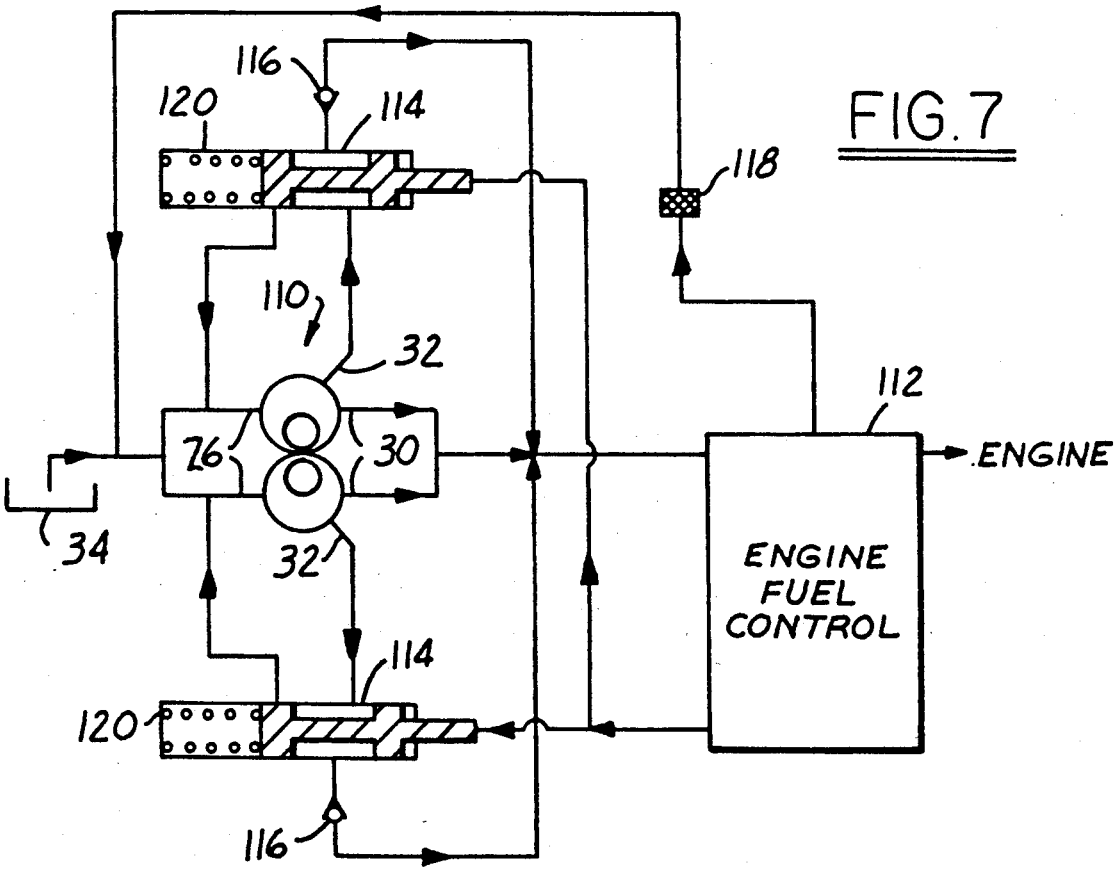
FIG. 7 is a schematic diagram of a hydraulic system employing the pump of FIG. 6.

FIGS. 6 and 7 illustrate a rotary hydraulic machine 110 in accordance with the present invention configured as a rotary vane pump in which rotor 12 is splined to shaft 14, which in turn extends from the pump housing for coupling to a suitable source of motor power (not shown). Cam ring surface 22 is contoured in the configuration of FIG. 6 such that first outlet ports 30 form the primary or high-pressure outlet ports, and second outlet ports 32 form the secondary lower-pressure outlet ports. Ports 30 are connected to an engine fuel control system 112 (FIG. 7). Ports 32 are individually connected to associated shuttle valves 114 for selectively connecting ports 32 either to ports 30 at the input to engine control system 112 through check valves 116, or to input ports 26 of pump 110. Engine control system 112 provides control lines to shuttle valves 114, and also provides a return path for fuel to the inlet of pump 110 through a filter 118. During periods of high engine fuel demand, such as during starting, control 112 limits pressure to shuttle valve 114, so that the shuttle valves assume the positions illustrated in FIG. 7 under control of associated springs 120 and connect secondary pump outlet ports 32 to primary ports 30. On the other, when such secondary pump outlet fuel is not required for engine operation, control 112 interconnects ports 32 with inlet ports 26, so that excess fuel is returned to the pump inlet and not feed to the engine. Thus, pump energy is conserved.

Figure 2:
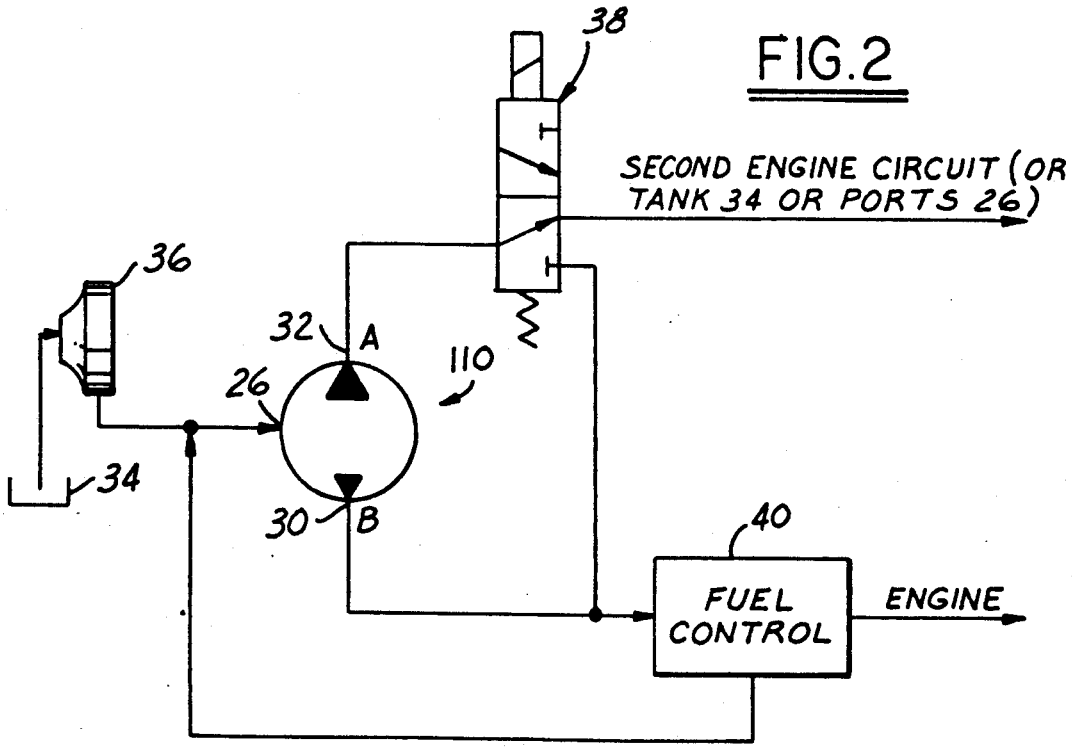
FIG. 2 is a schematic diagram of a hydraulic system employing the machine in FIG. 6 as a fluid flow mechanism capable of providing flow to two individual and distinct circuits.

FIG. 2 is a schematic diagram of machine 110 connected as a fuel pumping mechanism for control of fuel flow to a jet engine or the like. Inlet ports 26 receive fuel from a source 34 and a booster 36. Ports 32 are connected together to form a first discharge A coupled to a solenoid valve 38 that normally feeds fluid from discharge A to secondary engine circuits (or to the airframe tank or to inlet ports 26). Ports 30 are connected together to form a second discharge B connected to a fuel control system 40 for normal engine operation. The fuel from discharge A is normally directed to inlet ports 26, and is selectively directed from discharge A to the engine during periods of high fuel demand, such as when starting the engine. Solenoid valve 38 may be activated by associated control electronics (not shown) for coupling discharge A to discharge B at the inlet to fuel control system 40 and circulating all fuel through machine 110 when the engine is idle. Thus, in the embodiment of FIGS. 6 and 2, machine 110 is configured as a pumping mechanism in which the ratio of the cam rise from the inlet port to the cam fall leading to discharge ports 32 determines the flow division ratio. Discharge ports 30 function not only to reposition the vanes for the next pumping cycle, but also to provide a secondary fluid outlet at a selected pressure for use as desired.

We claim:

1. A rotary hydraulic machine that comprises: a housing, a rotor mounted for rotation within said housing and having a plurality of radially extending peripheral slots, a plurality of vanes individually slidably mounted in said slots, means forming a cam ring within said housing surrounding said rotor and having a radially inwardly directed surface forming a vane track and at least one fluid pressure cavity between said surface and said rotor, and fluid inlet and outlet means in said housing coupled to said cavity; characterized in that said fluid inlet and outlet means comprises:

means for receiving hydraulic fluid and directing such fluid to said cavity through a cavity inlet port adjacent to one circumferential edge of said cavity, means including a first cavity outlet port adjacent to an opposing circumferential edge of said cavity for directing fluid from said cavity along a first outlet path, means including a second cavity outlet port positioned circumferentially of said rotor between said inlet port and said first outlet port for directing fluid from said cavity along a second flow path different from said first flow path and at flow characteristic different from that in said first flow path, and means for selectively directing fluid at outlet pressure from at least one of said first and second outlet ports to said inlet port.

2. The machine set forth in claim 1 wherein said cam ring and rotor are constructed and arranged to form two of said cavities radially symmetrically positioned with respect to each other, said inlet port and said first and second outlet ports being identically positioned in said cavities.

3. A split-discharge balanced dual-lobe rotary hydraulic machine that comprises: a housing, a rotor mounted for rotation within said housing and having a plurality of radially extending peripheral slots, a plurality of vanes individually slidably mounted in said slots, means forming a cam ring within said housing radially surrounding said rotor and having a radially inwardly directed surface forming a vane track and a pair of diametrically opposed symmetrically positioned fluid pressure cavities between said surface and said rotor, a fluid inlet in said housing including a inlet port opening into each said cavity at a leading circumferential edge thereof with respect to direction of rotation of said rotor within housing, a first fluid outlet in said housing including a first fluid outlet port opening into each said cavity at a trailing circumferential edge thereof with respect to direction of rotation of said rotor, and a second fluid outlet in said housing separate from said first fluid outlet and including a second fluid outlet port opening into each said cavity circumferentially between a said inlet port and the associated said first outlet port, said inlet ports, said first outlet ports and said second outlet ports being positioned in diametrically opposed pairs with respect to said rotor, said housing comprising a cup-shaped enclosure, and first and second backup plates telescopically received within said cup-shaped enclosure and having said rotor sandwiched therebetween, said fluid inlet including a radially oriented inlet opening in said enclosure in radial alignment with said rotor and inlet passage means in one of said backup plates connecting said inlet opening to both of said inlet ports, said first and second fluid outlets including a pair of spaced annular channels on a radially outwardly facing surface of the other of said backup plates, first passage means in said other backup plate coupling a first of said channels to both of said first outlet ports, second passage means in said other backup plate coupling the second of said channels to both of said second outlet ports, and a pair of radially oriented outlet openings in said enclosure in respective radial alignment with said channels.

4. The machine set forth in claim 3 further comprising means for selectively directing fluid from at least one of said first and second outlet openings to said inlet opening.

* * * * *